US006986332B2

(12) United States Patent
Wians

(10) Patent No.: US 6,986,332 B2
(45) Date of Patent: Jan. 17, 2006

(54) ELECTRIC STARTER APPARATUS AND METHOD WITH MULTI-STAGE GEARING FOR STARTING AN INTERNAL COMBUSTION ENGINE

(75) Inventor: Jeffrey A. Wians, Mebane, NC (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/455,133

(22) Filed: Jun. 5, 2003

(65) Prior Publication Data

US 2004/0244755 A1 Dec. 9, 2004

(51) Int. Cl.
*F02N 11/00* (2006.01)

(52) U.S. Cl. ..... 123/179.26; 56/10.5; 74/6; 74/7 E

(58) Field of Classification Search ..... 123/179.25, 123/179.26; 74/7 E, 6; 56/10.5, 17.5
See application file for complete search history.

(56) References Cited

U.S. PATENT DOCUMENTS 3,696,593 A * 10/1972 Thorud et al. ..... 56/17.5
4,346,151 A * 8/1982 Uba et al. ..... 429/54
4,422,283 A * 12/1983 Scanland ..... 56/17.5
4,507,566 A 3/1985 Leatherman et al. ..... 290/38 R
4,561,316 A * 12/1985 Bolz et al. ..... 74/7 E
4,605,605 A * 8/1986 Cannone ..... 429/174
5,159,845 A 11/1992 Wada et al. ..... 74/6
5,494,010 A * 2/1996 Niimi et al. ..... 123/179.25
5,755,137 A 5/1998 Tomida ..... 74/7 E
6,305,337 B1 * 10/2001 Sumi et al. ..... 123/179.25

* cited by examiner

*Primary Examiner*—Andrew M. Dolinar
(74) *Attorney, Agent, or Firm*—Jenkins, Wilson & Taylor P.A.

(57) ABSTRACT

An electric starter apparatus and method with three-stage gearing and method for starting an internal combustion engine. The apparatus includes a starter assembly, a first gear, a second gear, a third gear, a fourth gear and an engine shaft. The starter assembly includes an electric starter motor and a starter motor shaft communicating with the starter motor. The starter motor shaft is rotatable in response to energizing of the starter motor. The first gear is attached to the starter motor shaft for rotation therewith. The second gear engages the first gear, the third gear engages the second gear, and the fourth gear engages the third gear. The fourth gear is attached to the engine shaft for communicating with an internal combustion engine. The engine is started by energizing the starter motor to rotate the starter motor shaft, the gears, and the engine shaft. The arrangement of gears enables the use of a low-torque/high-rpm electric starter motor in combination with a nickel-cadmium battery.

29 Claims, 4 Drawing Sheets

ELECTRIC STARTER APPARATUS AND METHOD WITH MULTI-STAGE GEARING FOR STARTING AN INTERNAL COMBUSTION ENGINE

TECHNICAL FIELD

The present invention generally relates to starter systems for starting internal combustion engines. More particularly, the present invention relates to a gear arrangement associated with an electric starter motor for starting internal combustion engines such as lawnmower engines.

BACKGROUND ART

Internal combustion engines are typically started or "cranked" through the use of an electric starter system. The electric starter system typically includes an electric motor having a rotational output such as a shaft, a source of electrical energy for the electric motor such as a DC battery, and a mechanical interface such as a gear train between the electric motor and the engine suitable for transferring the rotational output of the electric motor to the engine. The rotational energy produced by the electric motor is transferred with an amount of torque and angular velocity sufficient to turn a primary shaft of the motor such as its crankshaft and initiate internal combustion, after which time the operation of the engine is sustained by dedicated fuel-air and spark delivery systems.

Starter systems including electric starter motors and gear trains are presently being implemented with powered equipment such as lawnmowers, whose small engines have traditionally been manually started by means of a pull cord. For powered equipment such as lawnmowers and the like, conventional starter systems have included two-stage gear arrangements.

Referring now to FIG. 1, a schematic illustration is given for a conventional two-stage gear arrangement, generally designated 10, that typically is employed for starter assemblies. Two-stage gear arrangement 10 consists of a first gear G1 which can be intermeshed with a second gear G2 that in turn can be intermeshed with a third gear G3. Although not specifically shown, it will be appreciated by persons skilled in the art that each gear G1–G3 has a series of teeth formed around its periphery, such that the teeth of each gear G1–G3 engage the teeth of an adjacent gear G1–G3. Accordingly, as a result of these intermeshing engagements, rotation of first gear G1 causes rotation of second gear G2, and rotation of second gear G2 likewise causes rotation of third gear G3. Alternatively, gears G1–G3 could be non-toothed wheels constructed in whole or in part from a suitable frictional material such as rubber.

First gear G1 represents a pinion gear that is typically coaxially attached to an output or starter motor shaft SMS of a starter motor (not shown). Second gear G2 is typically an idler gear attached to a rotatable stub shaft SS. Third gear G3 represents a large-diameter gear that is typically coaxially attached to an engine shaft ES of an internal combustion engine (not shown), such as the engine of a lawnmower. Engine shaft ES is typically a crankshaft that is directly coupled to the engine. In the case of a lawnmower, one or more cutting blades can be directly attached to the crankshaft such that the crankshaft provides the torque needed to drive the cutting blades. Alternatively, engine shaft ES is an output shaft that is coupled to the crankshaft through a clutch or other suitable means for selectively engaging and disengaging the output power of the engine from the cutting blades to control the operation of the cutting blades. First gear G1, second gear G2, third gear G3, and their associated shafts SMS, SS, and ES rotate about separate axes of rotation A1, A2, and A3, respectively.

The starter motor is typically an electric DC motor that is energized either through connection with a battery or to a suitable electrical power source such as an electrical outlet providing standard AC line voltage. In the case where the electric motor is to be connected to an electrical outlet, an AC/DC converter is required on the input side of the electric motor to provide rectified DC power to the electric motor. Alternatively, the starter motor could be an AC motor.

In operation, the starter motor is energized to rotate first gear G1, thereby forcing second gear G2 and third gear G3 to rotate. Because third gear G3 is fixedly attached to engine shaft ES, third gear G3 drives the rotation of engine shaft ES. As is appreciated by persons skilled in the art, the rotation of engine shaft ES causes one or more internally disposed pistons communicating with engine shaft ES to reciprocate. The resulting reciprocation of the piston, in combination with the priming of the engine with an appropriate fuel-air mixture and the discharging of a spark plug communicating with the cylinder enclosing the piston, initiates combustion within the cylinder and thereby starts the engine. Typically, a suitable means is provided for decoupling third gear G3 or second gear G2 from the remaining portion of the gear train, so that starter motor shaft SMS of the starter motor ceases to rotate once the engine has been started.

Typically, the resultant gear ratio (also termed the angular-velocity ratio) provided by two-stage gear arrangement 10 is 19.4:1, which is the ratio of the input angular velocity (that of first gear G1) to the output angular velocity (that of third gear G3). As is appreciated by persons skilled in the art, the gear ratio of any gear train depends on the number of teeth provided on each participating gear. Two-stage gear arrangements such as gear arrangement 10 illustrated in FIG. 1 typically require the use of a high-torque, low-rpm (300–600 rpm) electric motor to successfully turn engine shaft ES and consequently start the engine.

A mechanism for decoupling the starter motor from its associated engine can be provided to prevent the output shaft of a starter motor from needlessly rotating after its associated engine has been started and possibly damaging or wearing out the starter motor. Examples of starter assemblies that include two-stage gear arrangements and decoupling mechanisms are disclosed in U.S. Pat. No. 4,507,566 to Leatherman et al. and U.S. Pat. No. 5,755,137 to Tomida. Leatherman et al. disclose a starter assembly for a gasoline engine-powered lawnmower in which a starter assembly is pivotably mounted adjacent to the engine and above a mower deck that houses cutting blades. The starter assembly includes an electric starter motor, an output shaft, and an associated pinion gear, which together are movable along an arcuate slot between engaged and disengaged positions. An operator manipulates a bell crank and associated linkage to move the starter assembly into the engaged position, in which the pinion gear meshes with a gear rotatably connected with the engine. Tomida discloses a starter assembly typically used in larger engines provided with motor vehicles. The starter assembly of Tomida utilizes a magnet switch to actuate the pinion gear of the starter assembly into engagement with a ring gear rotatably connected with the engine through its crankshaft.

As in the case of a typical two-stage gear arrangement such as two-stage gear arrangement 10, the two-stage gear assemblies of powered equipment such as disclosed by Leatherman et al. and Tomida typically require the use of a high-torque, low-rpm electric motor. In some cases, however, the use of a high-torque, low-rpm electric motor as the starter motor is not desirable. In particular, it is proposed herein to employ a high-performance battery such as a nickel-cadmium (NiCd or "NiCad"), nickel metal hydride, or lithium ion battery in conjunction with engine-powered equipment to provide stored energy for an electric starter apparatus. It has been found that the use of a NiCd battery in conjunction with a high-torque, low-rpm electric motor does not provide acceptable reliability and performance. Accordingly, it is proposed to provide a lower-torque/higher-rpm electric starter motor for use in conjunction with the NiCd or other high-performance battery. However, it has further been found that a conventional two-stage gear arrangement such as illustrated in FIG. 1 and disclosed by Leatherman et al. and Tomida is not compatible with lower-torque/higher-rpm electric starter motors. Therefore, an acknowledged need exists in the art for an improved gear arrangement that can support the use of a low-torque/high-rpm electric starter motor.

SUMMARY

The invention generally provides an apparatus for starting an internal combustion engine that comprises a multi-stage gear system for coupling an electric starter motor with the internal combustion engine. The invention is particularly advantageous when implemented in powered equipment such as lawnmowers, and in connection with starter motors powered by high-performance batteries. The invention also provides an engine-powered apparatus such as a lawnmower that incorporates the three-stage gear system. The invention further provides a method for starting an engine of an engine-powered apparatus, in which the starting energy produced by an electric starter motor is transferred to the engine through the three-stage gear system.

According to one embodiment, an apparatus for starting an internal combustion engine comprises a starter assembly comprising an electric starter motor, a starter motor shaft, and a first gear. The starter motor shaft communicates with the starter motor and is rotatable in response to energizing of the starter motor. The first gear is attached to the starter motor shaft for rotation therewith. A second gear engages the first gear and is rotatable therewith. A third gear engages the second gear and is rotatable therewith. The apparatus further comprises an engine shaft for communicating with an internal combustion engine. The fourth gear is attached to the engine shaft and is rotatable therewith.

According to another embodiment, an engine-powered apparatus comprises an internal combustion engine, a rotatable engine shaft communicating with the engine, a starter assembly, and a gear train. The starter assembly comprises an electric starter motor and a starter motor shaft communicating with the starter motor. The starter motor shaft is rotatable in response to energizing of the starter motor. The gear train comprises a first gear, a second gear, a third gear, and a fourth gear. The first gear is attached to the starter motor shaft and is rotatable therewith. The second gear engages the first gear and is rotatable therewith. The third gear engages the second gear and is rotatable therewith. The fourth gear engages the third gear and is rotatable therewith. The fourth gear is attached to the engine shaft. In one aspect, the apparatus comprises a mower deck defining an interior and a cutting blade disposed in the interior. The cutting blade is attached to the engine shaft and is rotatable therewith.

A method is provided for starting an engine of an engine-powered apparatus, and comprises the following steps. An electric starter motor is energized to rotate an output shaft that communicates with the starter motor. Energy is transferred from the output shaft to an engine shaft that communicates with an internal combustion engine. The energy is transferred by coupling the output shaft to the engine shaft through a gear train. The gear train comprises a first gear, a second gear, a third gear, and a fourth gear. The first gear is attached to the output shaft. The second gear is engaged with the first gear. The third gear is engaged with the second gear. The fourth gear is engaged with the third gear and is attached to the engine shaft. Rotation of the output shaft causes the first gear, second gear, third gear, fourth gear and engine shaft to rotate. The engine shaft rotates at a torque and angular velocity sufficient to start the engine.

It is therefore an object of the invention to provide an apparatus and method for starting an internal combustion engine that includes a gear arrangement enabling the use of an electric starter motor operative at low torque and high angular velocity.

An object of the invention having been stated hereinabove, and which is achieved in whole or in part by the invention disclosed herein, other objects will become evident as the description proceeds when taken in connection with the accompanying drawings as best described hereinbelow.

DETAILED DESCRIPTION OF THE INVENTION

Figure 1:
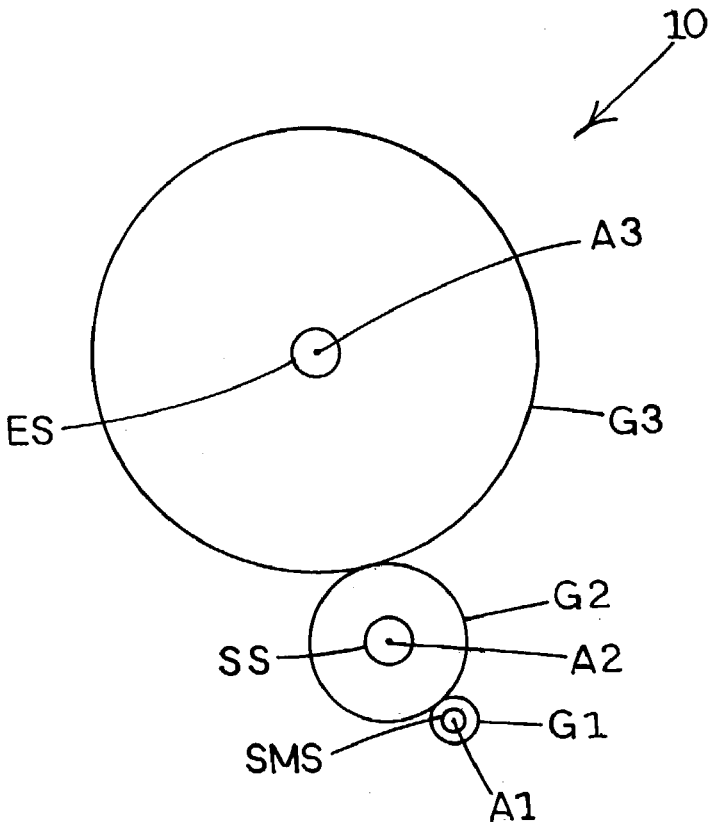
(PRIOR ART) FIG. 1
FIG. 1 is a schematic view of a 2-stage gear train known in the art.
Figure 2:
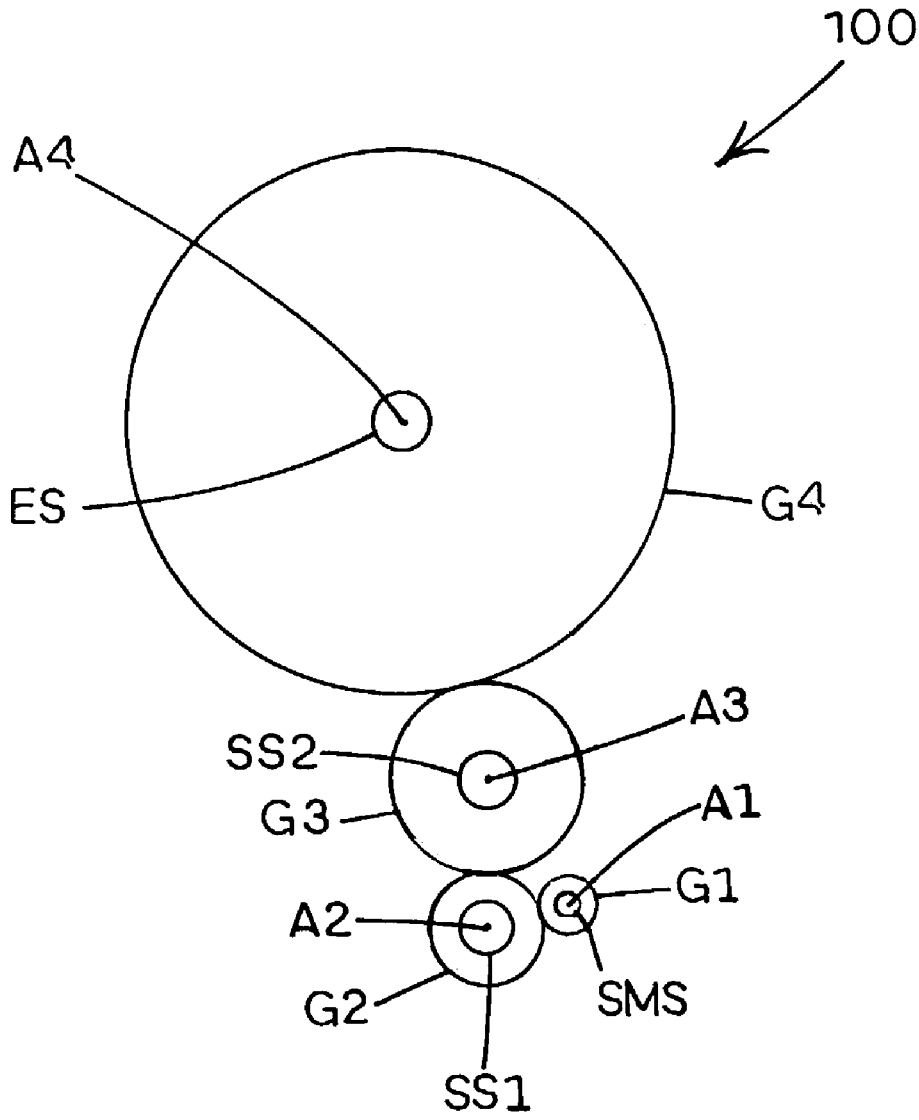
FIG. 2 is a schematic view of a 3-stage gear train according to an embodiment disclosed herein.
Figure 3:
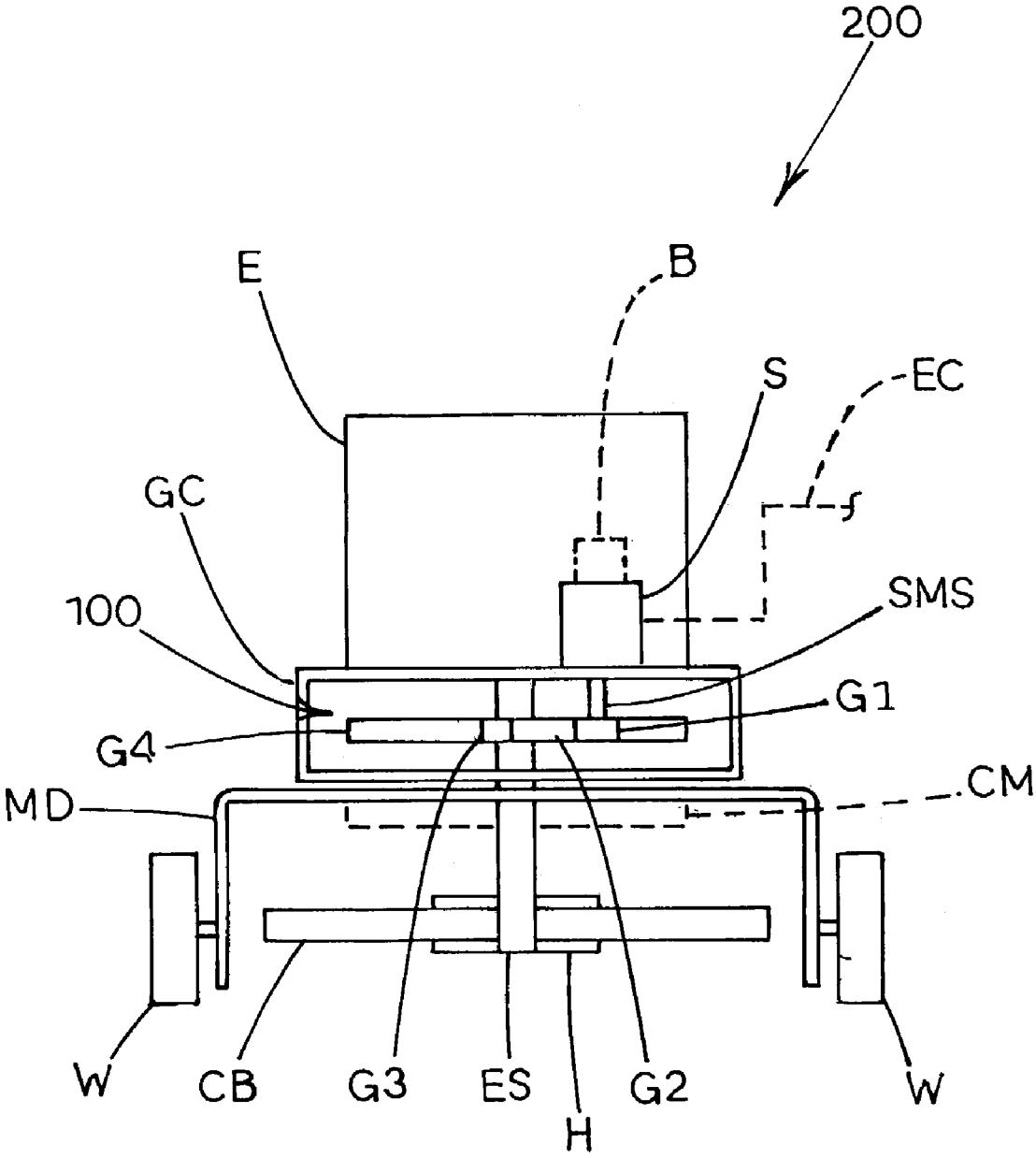
FIG. 3 is a cutaway front elevation view of a lawnmower including the 3-stage gear train.

Referring now to FIGS. 2 and 3, the invention in one embodiment provides a three-stage gear arrangement, generally designated 100, as an alternative to conventional two-stage gear arrangement 10 illustrated in FIG. 1. As best shown in FIG. 2, three-stage gear arrangement 100 is a gear train comprising first, second, third and fourth gears, G1–G4, respectively. First gear G1 represents the pinion gear of starter motor shaft SMS, and fourth gear G4 represents the large gear of engine shaft ES. Second gear G2 and third gear G3 are intermediate gears disposed between first gear G1 and fourth gear G4, and are attached to rotatable stub shafts SS1 and SS2, respectively. First gear G1, second gear G2, third gear G3, fourth gear G4, and their corresponding shafts rotate about separate axes of rotation A1, A2, A3 and A4, respectively. As is appreciated by persons skilled in the art, one or more of the gears of gear arrangement 100 could be disposed at different elevations relative to the other gears. For instance, first gear G1 could be disposed at a different elevation than third gear G3. In such case, second gear G2 illustrated in FIG. 2 would comprise two separate gears mounted to stub shaft SS1 with one of these gears disposed at the same elevation as first gear G1 for meshing engagement therewith, and the other gear disposed at the same elevation as third gear G3 for meshing engagement therewith. Alternatively, or additionally, the other intermediate gear, third gear G3 could comprise two separate gears if it were desired to dispose second gear G2 and fourth gear G4 at different elevations relative to each other.

Three-stage gear arrangement 100 can provide a larger overall gear ratio than two-stage gear arrangement 10 shown in FIG. 1. As an example, the gear ratio of three-stage gear arrangement 100 can range from approximately 100:1 to approximately 25:1. In one embodiment, the gear ratio of three-stage gear arrangement 100 can preferably be 39.2:1. The rotational speed of starter motor shaft SMS can range from, for example, 15,000–30,000 rpm. As a result of gear reduction through three-stage gear arrangement 100, the rotational speed of engine shaft ES can range from, for example, 300–600 rpm.

The greater gear reduction and associated higher gear ratio provided by three-stage gear arrangement 100 is advantageous when implemented in an engine-powered apparatus, an example of which is a lawnmower, generally designated 200 and illustrated in FIG. 3. While three-stage gear arrangement 100 is specifically described in the context of lawnmower 200, it will be understood that the invention in practice is not limited to implementation in lawnmowers. Rather, three-stage gear arrangement 100 can be utilized in any engine-powered apparatus employing a starter motor (especially a low-torque/high-rpm starter motor) and a gear reduction between the starter motor and the engine.

Lawnmower 200 generally comprises a mower deck MD supported on a ground surface by a set of, typically, three or four wheels W, two of which are shown in FIG. 3. An internal combustion engine E is mounted on mower deck MD. An output engine shaft ES extends from engine E into the interior defined by mower deck MD. One or more cutting blades CB are attached to engine shaft ES at a hub H. In operation, engine E turns engine shaft ES at high speed to drive the rotation of cutting blades CB. The configuration illustrated in FIG. 3 is typical of walk-behind lawnmowers, in which wheels W are connected to mower deck MD and engine E is supported on mower deck MD. The invention, however, is equally applicable to riding lawnmowers in which wheels W are attached to, and engine E is supported on, a frame or chassis that often is structurally separate from mower deck MD. Additional structural and operational details of walk-behind and riding lawnmowers are generally known to persons skilled in the art, and accordingly are not described further herein.

In the exemplary embodiment illustrated in FIG. 3, three-stage gear arrangement 100 is housed in a gear casing GC mounted on mower deck MD below engine E. Alternatively, gear casing GC could be mounted within mower deck MD. Gear casing GC is illustrated as being structurally separate from engine E, although both three-stage gear arrangement 100 and engine E could be housed in a unitary outer enclosure. An electric starter motor S is mounted on gear casing GC, with starter motor shaft SMS extending into gear casing GC for connection with first gear G1. Alternatively, electric starter motor S could be mounted to the side of the structural block of engine E. For clarity, stub shafts SS1 and SS2 (see FIG. 2) around which second and third gears G2 and G3 are respectively disposed are not shown in FIG. 3, but preferably are rotatably mounted within gear casing GC in any suitable manner. Fourth gear G4 is secured to a portion of engine shaft ES extending through gear casing GC. First, second, third, and fourth gears G1–G4 communicate with each other as shown in FIG. 2. As depicted schematically in FIG. 3, lawnmower 200 can also include a coupling mechanism CM of any suitable design for selectively decoupling the output power produced by engine E from cutting blades CB. As is appreciated by persons skilled in the art, coupling mechanism CM can comprise a ratchet, frictional plate, or belt driven clutch-type device. In such a case, engine shaft ES would consist of separate upper and lower portions connected on each side of coupling mechanism CM.

Preferably, a battery B provides electrical energy to starter motor S via a suitable lead wire connection (not shown), in which case starter motor S is a DC motor. Battery B is mounted to engine E proximate to starter motor S or could be mounted remotely from starter motor S such as at the handlebar (not shown) typically provided with lawnmower 200. Battery B can be any battery capable of providing a suitable voltage (e.g., 12–24 V) and current to starter motor S, such as a lead acid battery. Preferably, however, battery B is a NiCd, nickel metal hydride, or lithium ion battery that provides the advantages of long service life and quick rechargeability. As an alternative to the use of battery B, an electrical conduit EC could be provided to temporarily interconnect to starter motor S with the electrical outlet of a suitable AC voltage source when starting engine E. When electrical conduit EC is employed, starter motor S is either a DC motor with an AC/DC converter or an AC motor.

As indicated above, NiCd batteries cannot reliably provide the amperage needed for conventional high-torque, low-rpm starter motors. Therefore, it is preferable that starter motor S be rated at a lower torque and higher rpm when battery B is the NiCd type. One example of a low-torque, high-rpm starter motor S is commercially available from Johnson Electric, Shelton, Conn. Three-stage gear arrangement 100 advantageously supports the use of low-torque, high-rpm starter motor S, as its higher than conventional gear ratio enables starter motor S to sufficiently turn the gears G1–G4 of three-stage gear arrangement 100 at a much lower torque than heretofore possible while operating at higher angular velocities.

In the operation of lawnmower 200 or any other type of engine-powered equipment in which three-stage gear arrangement 100 is implemented, the user cranks engine E by operating a switch (not shown) or any other suitable means for closing the circuit between battery B and starter motor S, whereby starter motor S draws current from battery B. Upon energization, starter motor S causes starter motor shaft SMS to rotate first gear G1. Due to the interconnected relation of the gears G1–G4 of three-stage gear arrangement 100, all gears G1–G4 rotate in response to the energization of starter motor S. The rotation of fourth gear G4 drives the rotation of engine shaft ES with sufficient torque and angular velocity to start engine E. As appreciated by persons skilled in the art, any suitable mechanism could be provided for disengaging the transmission of force from starter motor S to engine E. For instance, second gear G2 could be mounted to a suitable BENDIX®-type coupling or ratchet. Such coupling systems are well known to persons skilled in the art, and accordingly will not be described further.

Figure 4:
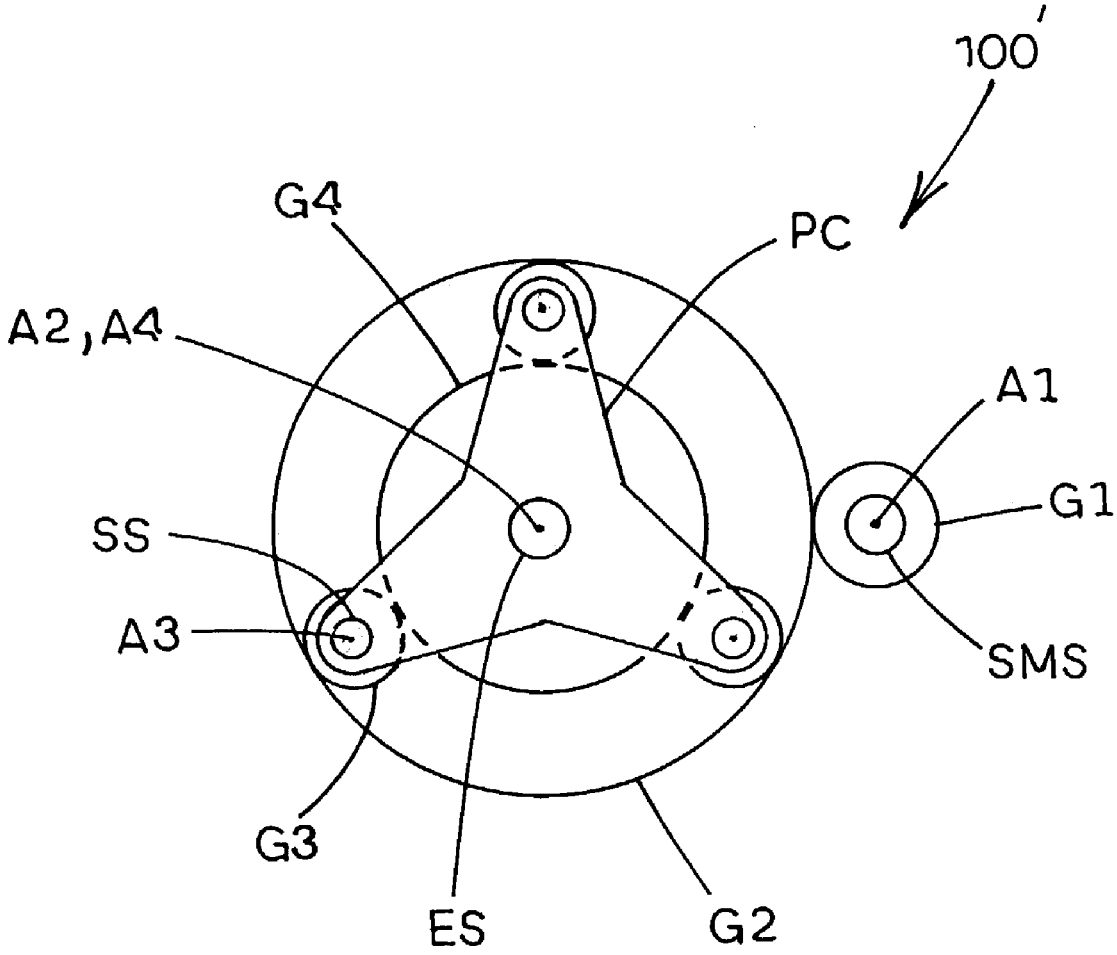
FIG. 4 is a schematic view of a planetary gear train according to another embodiment disclosed herein.

Referring now to FIG. 4, a planetary gear arrangement, generally designated 100, is illustrated as an alternative embodiment. The primary differences between planetary gear arrangement 100' of FIG. 4 and three-stage gear arrangement 100 of FIG. 2 are as follows. In FIG. 4, second gear G2 is structured as a double-toothed ring gear, having external teeth meshing with first gear G1 and internal teeth meshing with third gear G3. Fourth gear G4 attached to engine shaft ES serves as a fixed sun gear. Axis of rotation A2 of second gear G2 is coincident with axis of rotation A4 of fourth gear G4. One or more third gears G3 are attached to respective stub shafts SS, which in turn are rotatably mounted to a planet carrier PC. Planet carrier PC is rotatably supported on engine shaft ES and rotates about axis of rotation A2, A4. Each third gear G3 is intermeshed between second gear G2 and fourth gear G4. Accordingly, third gears G3 serve as planet gears and, along with their corresponding stub shafts SS and axes of rotation A3, rotate about fourth gear G4 and its axis of rotation A4.

The operation of planetary gear arrangement 100' when implemented in an engine-powered apparatus such as lawnmower 200 (see FIG. 3) can be essentially the same as described hereinabove with regard to three-stage gear arrangement 100 of FIG. 2. In practice, planetary gear arrangement 100' can be preferable over three-stage gear arrangement 100 because its planetary structure is more compact and could allow the use of a smaller starter motor. In addition, planetary gearing generally provides higher gear efficiency and lower cost. As appreciated by persons skilled in the art various other types of planetary gear arrangements could be employed as alternatives to planetary gear arrangement 100' specifically illustrated in FIG. 4. In some of these alternative arrangements, first gear G1 could serve as the sun or central gear.

It will be understood that various details of the invention may be changed without departing from the scope of the invention. Furthermore, the foregoing description is for the purpose of illustration only, and not for the purpose of limitation, as the invention is defined by the claims as set forth hereinafter.

What is claimed is:

1. A lawnmower having an internal combustion engine, the lawnmower comprising:

(a) a starter assembly comprising a low-torque electric starter motor for providing low-torque and a high rotational speed to a starter motor shaft, the starter motor shaft communicating with the starter motor and rotatable in response to energizing of the starter motor, and a first gear attached to the starter motor shaft for rotation therewith;

(b) a second gear in contact with and engaging the first gear and rotatable therewith;

(c) a third gear in contact with and engaging the second gear and rotatable therewith;

(d) a fourth gear in contact with and engaging the third gear and rotatable therewith; and (e) an engine shaft for communicating with the internal combustion engine, wherein the fourth gear is attached to the engine shaft and is rotatable therewith.

2. The lawnmower according to claim 1 comprising an electrical conduit communicating with the starter motor for transmitting electrical energy thereto.

3. The lawnmower according to claim 1 comprising a battery communicating with the starter motor for transmitting electrical energy thereto.

4. The lawnmower according to claim 3 wherein the battery comprises a lead acid battery.

5. The lawnmower according to claim 3 wherein the battery comprises a nickel-cadmium battery.

6. The lawnmower according to claim 1 wherein the starter motor is operable at a rotational speed ranging from approximately 15,000 to approximately 30,000 rpm.

7. The lawnmower according to claim 1 wherein two or more of the first, second, third, and fourth gears form a planetary gear set.

8. The lawnmower according to claim 1 wherein the first, second, third, and fourth gears cooperatively produce a gear ratio ranging from approximately 25:1 to 100:1.

9. The lawnmower according to claim 8 wherein the gear ratio is approximately 39.2:1.

10. The lawnmower according to claim 1 comprising a mower deck defining an interior and a cutting blade disposed in the interior and attached to the engine shaft.

11. The lawnmower according to claim 10 wherein the mower deck supports the engine and the starter motor.

12. The lawnmower according to claim 10 wherein the mower deck is attached to a frame and the frame supports the engine and the starter motor.

13. The lawnmower according to claim 1 wherein the lawnmower is a walk-behind lawnmower.

14. The lawnmower according to claim 10 wherein the mower deck supports the engine and the starter motor.

15. A method for starting a lawnmower engine, comprising the steps of:

(a) energizing a low-torque electric starter motor operatively connected to a lawnmower engine to rotate an output shaft communicating with the starter motor wherein the electric starter motor provides low-torque and a high rotational speed to the output shaft; and (b) transferring energy from the output shaft to an engine shaft communicating with the lawnmower engine by coupling the output shaft to the engine shaft through a gear train comprising a first gear attached to the output shaft, a second gear in contact and engaged with the first gear, a third gear in contact and engaged with the second gear, and a fourth gear in contact and engaged with the third gear and attached to the engine shaft, whereby rotation of the output shaft causes the first gear, second gear, third gear, fourth gear, and engine shaft to rotate, and the engine shaft rotates at a torque and angular velocity sufficient to start the lawnmower engine.

16. The method according to claim 15 wherein energizing the starter motor comprises supplying energy from an electrical energy source through an electrical conduit communicating with the starter motor.

17. The method according to claim 15 wherein energizing the starter motor comprises supplying energy from a battery.

18. The method according to claim 17 wherein the battery comprises a lead acid battery.

19. The method according to claim 17 wherein the battery comprises a nickel-cadmium battery.

20. The method according to claim 15 wherein the starter motor operates at a rotational speed ranging from approximately 15,000 to approximately 30,000 rpm.

21. The method according to claim 15 wherein the first, second, third, and fourth gears cooperatively produce a gear ratio ranging from approximately 25:1 to 100:1.

22. The method according to claim 21 wherein the gear ratio is approximately 39.2:1.

23. An apparatus for starting an internal combustion engine, comprising:

(a) a starter assembly comprising an electric starter motor, a starter motor shaft communicating with the starter motor and rotatable in response to energizing of the starter motor, and a first gear attached to the starter motor shaft for rotation therewith;

(b) a second gear engaging the first gear and rotatable therewith;

(c) a third gear engaging the second gear and rotatable therewith;

(d) a fourth gear engaging the third gear and rotatable therewith;

(e) an engine shaft for communicating with an internal combustion engine, wherein the fourth gear is attached to the engine shaft and is rotatable therewith;

(f) wherein two or more of the first, second, third, and fourth gears form a planetary gear set; and (g) further wherein the third gear is rotatable around the fourth gear.

24. An engine-powered apparatus comprising:

(a) an internal combustion engine;

(b) a rotatable engine shaft communicating with the engine;

(c) a starter assembly comprising an electric starter motor and a starter motor shaft communicating with the starter motor and rotatable in response to energizing of the starter motor;

(d) a gear train comprising a first gear attached to the starter motor shaft and rotatable therewith, a second gear engaging the first gear and rotatable therewith, a third gear engaging the second gear and rotatable therewith, and a fourth gear engaging the third gear and rotatable therewith, the fourth gear being attached to the engine shaft;

(e) wherein two or more of the gears of the gear train form a planetary gear set; and (f) further wherein the third gear is rotatable around the fourth gear.

25. A method for starting an engine of an engine-powered apparatus, comprising the steps of:

(a) energizing an electric starter motor to rotate an output shaft communicating with the starter motor; and (b) transferring energy from the output shaft to an engine shaft communicating with an internal combustion engine by coupling the output shaft to the engine shaft through a gear train comprising a first gear attached to the output shaft, a second gear engaged with the first gear, a third gear engaged with the second gear, and a fourth gear engaged with the third gear and attached to the engine shaft, whereby rotation of the output shaft causes the first gear, second gear, third gear, fourth gear, and engine shaft to rotate, wherein rotation of the output shaft also causes the third gear to rotate around the fourth gear, and wherein the engine shaft rotates at a torque and angular velocity sufficient to start the engine.

26. A lawnmower having an internal combustion engine, the lawnmower comprising:

(a) a starter assembly comprising an electric starter motor for providing a high rotational speed to a starter motor shaft, the starter motor shaft communicating with the starter motor and rotatable in response to energizing of the starter motor, and a first gear attached to the starter motor shaft for rotation therewith;

(b) a second gear engaging the first gear and rotatable therewith;

(c) a third gear engaging the second gear and rotatable therewith;

(d) a fourth gear engaging the third gear and rotatable therewith;

(e) an engine shaft for communicating with the internal combustion engine, wherein the fourth gear is attached to the engine shaft and is rotatable therewith; and (f) wherein two or more of the first, second, third, and fourth gears form a planetary gear set, and wherein the third gear is rotatable around the fourth gear.

27. A method for starting a lawnmower engine, comprising the steps of:

(a) energizing an electric starter motor operatively connected to a lawnmower engine to rotate an output shaft communicating with the starter motor wherein the electric starter motor provides a high rotational speed to the output shaft;

(b) transferring energy from the output shaft to an engine shaft communicating with the lawnmower engine by coupling the output shaft to the engine shaft through a gear train comprising a first gear attached to the output shaft, a second gear engaged with the first gear, a third gear engaged with the second gear, and a fourth gear engaged with the third gear and attached to the engine shaft, whereby rotation of the output shaft causes the first gear, second gear, third gear, fourth gear, and engine shaft to rotate, and the engine shaft rotates at a torque and angular velocity sufficient to start the lawnmower engine; and (c) wherein rotation of the output shaft causes the third gear to rotate around the fourth gear.

28. A lawnmower having an internal combustion engine, the lawnmower comprising:

(a) a starter assembly comprising a low-torque electric starter motor for providing low-torque and a high rotational speed to a starter motor shaft, the starter motor shaft communicating with the starter motor and rotatable in response to energizing of the starter motor, and a first gear attached to the starter motor shaft for rotation therewith;

(b) a second gear engaging the first gear and rotatable therewith;

(c) a third gear engaging the second gear and rotatable therewith;

(d) a fourth gear engaging the third gear and rotatable therewith, wherein the first, second, third, and fourth gears respectively rotate about separate axes; and (e) an engine shaft for communicating with the internal combustion engine, wherein the fourth gear is attached to the engine shaft and is rotatable therewith.

29. A method for starting a lawnmower engine, comprising the steps of:

(a) energizing a low-torque electric starter motor operatively connected to a lawnmower engine to rotate an output shaft communicating with the starter motor wherein the electric starter motor provides low-torque and a high rotational speed to the output shaft; and (b) transferring energy from the output shaft to an engine shaft communicating with the lawnmower engine by coupling the output shaft to the engine shaft through a gear train comprising a first gear attached to the output shaft, a second gear engaged with the first gear, a third gear engaged with the second gear, and a fourth gear engaged with the third gear and attached to the engine shaft, wherein the first, second, third, and fourth gears respectively rotate about separate axes, and whereby rotation of the output shaft causes the first gear, second gear, third gear, fourth gear, and engine shaft to rotate, and the engine shaft rotates at a torque and angular velocity sufficient to start the lawnmower engine.

* * * * *